United States Patent [19]

Melotik

[11] 3,969,152

[45] July 13, 1976

[54] RARE EARTH METAL RINSE FOR METAL COATINGS

[75] Inventor: Donald J. Melotik, Dearborn Heights, Mich.

[73] Assignee: Stauffer Chemical Company, Westport, Conn.

[22] Filed: Apr. 15, 1974

[21] Appl. No.: 461,185

[30] Foreign Application Priority Data

June 6, 1973 Canada ..... 173338

[52] U.S. Cl. ..... 148/6.15 Z; 148/6.14 R; 148/6.14 A; 148/6.15 R; 148/6.2

[51] Int. Cl.[2] ..... C23F 7/10

[58] Field of Search ..... 148/6.15 R, 6.15 Z, 148/6.2, 6.16

[56] References Cited

UNITED STATES PATENTS

| | | | |
|---|---|---|---|
| 2,400,255 | 5/1946 | Pfeil | 117/231 X |
| 2,698,266 | 12/1954 | Thirsk | 148/6.2 |
| 3,493,441 | 2/1970 | Rausch et al. | 148/6.21 |
| 3,752,707 | 8/1973 | Newell et al. | 148/6.2 |

OTHER PUBLICATIONS

Kirk–Othmer, Encyclopedia of Chem. Tech., 1966, vol. 4, p. 850.

*Primary Examiner*—Ralph S. Kendall
*Attorney, Agent, or Firm*—Charles B. Rodman

[57] ABSTRACT

A final rinse for conversion coated metal surfaces comprising an aqueous acidic solution of a salt of a rare earth metal is disclosed. The rinse of the present invention not only yields coatings having excellent corrosion resistance and superior receptivity toward subsequent coatings of paint but is also easily disposable without harmful effects on the environment.

13 Claims, No Drawings

RARE EARTH METAL RINSE FOR METAL COATINGS

BACKGROUND OF THE DISCLOSURE

In the art of preparing metal surfaces to receive paint, it is widely known that the formation of various conversion coatings such as coatings of phosphates, mixed phosphate-oxides, chromates, oxalates and arsenates, on the surface of the metal substantially increases the corrosion resistance and humidity resistance of the final painted surface. Likewise, the use of manganese phosphate coatings has been found to increase the lubricity of the metal surface. It is also well known that the effectiveness of these coatings is substantially increased by the application to the coated surface of a dilute solution of chromium and its various forms, i.e., chromic acid, hexavalent chromium and/or trivalent chromium; said solution optionally containing other ingredients such as phosphoric acid, a reducing agent for chromium such as formaldehyde or straight polyalcohols, wetting agents, pH adjusters and the like. Thus, in the commericial, high speed, production line processing of metal parts for painting, the predominant processes apply the phosphate or other conversion coating from an aqueous bath and, after water rinsing the formed chemical coating, it is subjected to the aqueous chromium rinse either by spraying or dipping. In many processes the chromium rinse step is then followed by an additional deionized water rinse to remove uneven concentrations of the chromium on the surface of the metal. While all of these processes increase the corrosion resistance of the metal surfaces, they all have a very serious drawback, namely, the fact that the chromium contained in both the chromium and water rinses cannot effectively be removed from these solutions. Consequently, even after extensive efforts have been made to remove the chromium, some chromium will be carried over in the effluent of a metal processing plant into the environment, thereby creating a serious problem.

It is, therefore, an object of the present invention to provide a composition and process for rinsing conversion coated metal surfaces to substantially increase the corrosion and humidity resistance of such surfaces, which composition and process does not pose a threat to the surrounding environment.

Another object of the present invention is to provide a composition and process for rinsing conversion coated metal surfaces to improve the surface's receptivity to subsequent adherent coats of paint, which composition and process does not pose a threat to the surrounding environment.

It is a further object of the present invention to provide a final rinse for conversion coated metals which rinse, while yielding coatings of superior corrosion resistance, can be easily and economically treated to yield relatively pure effluent from said process. Other objects will be apparent from the following description.

DETAILED DESCRIPTION OF THE DISCLOSURE

It has now been discovered that the objects of the present invention can be realized by employing a final rinse solution comprising an aqueous acidic solution of a salt of a rare earth metal in lieu of the chromium type rinses in conventional high speed metal processing. More particularly, this invention provides a process which includes the conventional steps which are employed in high speed production line operation, namely, cleaning the metal surface, optionally water rinsing it, applying the phosphate or other conversion coating to the metal surface, and preferably water rinsing the metal surface, followed by a final rinse in the rare earth metal rinse solution of the present invention. The rare earth metal rinse can also be followed by a water rinse to remove excess ions, although this is not necessary. It has been found to be especially desirable, however, to employ a deionized water rinse prior to painting the surface by electrocoating techniques.

The final rinse solution of the present invention is an aqueous acidic solution of a salt of a rare earth metal. The term rare earth metal as used herein is meant to designate those elements of the lanthanide series of the Periodic Table of Elements. Since one of the primary objects of the present invention is to provide a final rinse solution which is not detrimental to the environment, it will be readily appreciated that only those rare earth metal salts which do not form naturally occurring radioactive isotopes to any appreciable extent are practical for use in the present invention. Illustrative of these rare earth metal salts which can be used are the salts of cerium, lanthanum, samarium, and praseodymium. While all of the above named rare earth metal salts can be employed, the salts of cerium and particularly the cerous salts, i.e., the trivalent salts of cerium, have been found to be particularly preferred, even as compared to other rare earth metal salts within the broader scope of the present invention. These cerous salts can be added as such or generated by in situ reduction of ceric salts. Furthermore, they can be added as mixed salts such as cerous magnesium nitrate. The anion portion of the rare earth metal salt should be such that the salt has sufficient solubility in weakly acidic media to provide a sufficient concentration of rare earth metal ions in the solution as will be discussed hereinafter. A wide variety of salts such as halides, and particularly iodides and fluorides, nitrate, acetate, sulfate, and gluconate. While any of the above anions can be used, the nitrate salts, and particularly cerous nitrate, have been found to be preferred. While applicant does not intend to be limited by any particular theory, it is believed that the oxidizing character of the nitrate anion makes it particularly suited for use in the present invention.

The rare earth metal salt solutions suitable for use in the present invention are acidic and have a pH in the range from about 2 to 6.5. The most advantageous pH for a particular application will depend upon the type of conversion coating which is being rinsed and the type of paint which is being applied subsequent to rinsing. This can be easily determined by one skilled in the art without undue experimentation. For example, zinc phosphate conversion coatings are most preferably rinsed with a rare earth metal salt solution having a pH in the range from about 3.0 to about 6.0 whereas iron phosphate coated surfaces are most preferably rinsed with solutions having a pH of from about 2.5 to about 5.5. Similarly, surfaces which are to be painted with an electrodeposition paint are preferably rinsed with a solution having a pH in the range from about 3.0 to about 6.5 whereas slightly lower pH's, in the range of 2.5 to 5.5 are preferable for solvent type paint systems. Consequently, for most applications the solutions of the present invention will preferably have a pH in the range from 2.5 to 6 and most preferably 2.8 to 5.0.

In preparing the rinse solution of the present invention it will normally be necessary to adjust the pH of the rare earth metal salt solution to the desired range by adding an acid to the solution of the rare earth metal salt. While the particular acid is not critical, certain acids have been found to give exceptionally good results with respect to yielding a coating which possesses superior corrosion and paint adherence characteristics. Thus, while mineral acids such as hydrofluoric, hydrochloric, sulfuric, and nitric as well as organic acids such as acetic, gluconic, phytic can all be used, best results have been achieved with nitric, phytic and gluconic acid. Even within this preferred class, nitric acid has given substantially better results in certain instances. While the reason for this is not clearly understood, it is believed that the oxidizing nature of nitric acid is at least partially responsible for its exceptional performance.

The concentration of the rare earth metal salt can be varied over a wide range. However, for most applications, the salt concentration should be at least 0.000001 M and preferably at least 0.00001 M, with concentrations greater than 0.0005 M being most preferred. The upper limit of the rare earth metal concentration is not critical and will only be limited by the solubility of the particular salt used.

For most commercial applications, the solutions of the present invention can be formulated as concentrates which are easier to store and transport and which can be diluted to the proper concentration for use at the location of use. Thus, another embodiment of the present invention relates to novel rinse concentrates comprising a concentrated aqueous acidic solution of a rare earth metal salt and an acid in sufficient concentration to give a solution having a molarity and pH within ranges disclosed above when diluted with an appropriate amount of water.

In accordance with the present invention a conversion coated metal surface is rinsed with the aqueous acidic solution of a salt of a rare earth metal. The term conversion coated metal surface is meant to designate surfaces of metals normally susceptible to corrosion such as iron, steel, zinc, aluminum, and the like, which surfaces have been coated with any of the well known conversion coatings such as the coatings of phosphates, mixed phosphate-oxides, chromates, oxalates, arsenates, and the like. These coatings are applied to the metal after it has been properly cleaned according to any of the well known degreasing and cleaning methods. Thus, the metal surface can be cleaned by solvent wiping, vapor degreasing, rinsing in an alkaline cleaning solution or combinations thereof. The cleaning step can alternatively be combined with the coating step by employing commercially available cleaningcoating solutions. Employing the alkaline rinse cleaning technique, it is customary to dip or spray the surface with the cleaning solution for a period of from about 10 seconds to about 10 minutes and then water rinse it for a like period of time. The metal surface can also be abraded, either by chemical or mechanical means, if deemed desirable. This abrading step is most commonly accomplished by grit-blasting or acid pickling the metal surface and can be done prior to or after the cleaning step. Following the cleaning and/or abrading steps, the metal surface is normally water rinsed to remove the cleaning and/or abrading agents. The metal surface is then coated with the conversion coating by any of the known methods such as immersion, spraying, flooding, flowing or like techniques. As stated earlier, any of the well known conversion coating solutions can be used. However, the present invention is particularly adapted to phosphate coatings and particularly zinc, calcium-zinc, iron and/or manganese phophates. These preferred phosphate solutions are aqueous acidic solutions which can additionally contain various accelerators such as nitrite ions and chlorate ions, various well know wetting agents, particularly those of the anionic or non-ionic type and the like. Particularly preferred in the present invention are the zinc and iron phosphate solutions. The phosphate solutions normally have a pH in the range from about 2 to about 6, with ranges from about 2 to about 5.5 being employed with zinc and iron phosphate solutions. The conversion coating step is normally conducted by contacting the metal surface with the coating solution for a period of about 30 seconds to about 30 minutes at temperatures in the range of about 120° to about 200°F.

The conversion coating step can then be followed by a water rinse step. This rinse is optional, but it has been found desirable in order to avoid contamination of the rare earth metal rinse solution.

The rare earth metal rinsing of the present invention is accomplished by simply applying the rinse to the conversion coated metal surface by any of the well known rinsing methods such as spraying, dipping, brushing, flowing, flooding or the like. The metal surface should normally be in contact with the rinse solution for a period of from about 5 seconds to about 120 seconds. The temperature of the rinsing solution is not critical, however, it is normally in the range from about room temperature to about 180°F.

After the rare earth metal rinse has been applied to the conversion coated surface, the surface can be water rinsed, however, this is not necessary. It has been found desirable to employ a deionized water rinse subsequent to the rinse and prior to painting the surface by any of the well known electrocoating techniques. The temperature of this water rinse can vary since it is not critical.

The metal surfaces, which have been treated by the process of the present invention can be painted wet or dried prior to painting. The drying can be accomplished by air drying, force drying or baking of the surfaces according to well known techniques. Painting of the metal surface is accomplished by spraying, dripping, electrocoating, electrostatic spraying, flowing, powder coating, or other well known methods.

A particular advantage of the present invention is the ease with which the effluent of the rinse can be purified. Thus, the pH of the rinse is raised to above 7 by addition of a base, thereby precipitating the hydroxide or the rare earth metal can be precipitated as a carbonate, oxalate or phosphate.

EXAMPLE I

Flat polished cold rolled steel panels measuring 4 by 12 inches are subjected to the cleaning and conversion coating cycle outlined in Table I.

TABLE I

| Treatment | Time | Temperature |
|---|---|---|
| 1) spray-comercially available titanated cleaner sold as METACLEAN 138 under Trademark by Stauffer Chemical Company (concentration ½ oz/gal) | 60 seconds | 160°F. |
| 2) water rinse | 40 seconds | ambient |
| 3) spray-comercially available zinc phosphate coating sold under the Trademark METACOTE X (total acid = 11.8, free acid = 0.9, additive = 2.5) | 90 seconds | 150°F. |
| 4) water rinse | 40 seconds | ambient |
| 5) dip-rinse with the rinses listed in Table II | 30 seconds | see Table II |
| 6) rinse-deionized water | 30–45 seconds | ambient |
| 7) oven-dried | 10 minutes | 275°F. |

The panels are then painted with a 0.5-0.6 mil coat of a commercially available electrodeposition primer sold as Forbes ED-1036. After baking for 25 minutes at 385°F., the panels are painted with a 0.2-0.3 mil coat of Dupont 881-2154 sealer and a 1.6 mil coat of Dupont 926–99642 line acrylic lacquer, and subsequently baked for 30 minutes at 310°F.

After aging the panels for 72 hours, a line is scribed on the plates through to the metal surface and the panels are salt spray tested according to ASTM method B117-64. The panels are rated for scribe creep back at 168 and 336 hours. The results are contained in Table II.

TABLE II

| Rinse Concentrate | (% Base On Weight) | Rinse Solution | pH | Temperature | Scribe Creep Back 32nds of an inch 168hrs. | 336hrs |
|---|---|---|---|---|---|---|
| A) cerous nitrate hexahydrate | 30% | 60ml of concentrate A/8gal of water | 5.9 | 116°F. | 1 | 1 |
| water | 70% | | | | | |
| B) cerous nitrate hexahydrate | 25% | 55ml of concentrate B/8gal of water | 4.2–4.3 | 116°F. | 1 | 1 |
| technical grade gluconic acid(50%) | 40% | | | | | |
| water | 35% | | | | | |
| C) cerous nitrate hexahydrate | 30% | 32ml of concentrate C/8gal of water | 4.7 | 97°F. | 1 | 1 |
| nitric acid (42°Baume) | 10% | | | | | |
| water | 60% | | | | | |
| D) same as concentrate C | | 35ml of concentrate C/8gal of water | 4.0 | 97°F. | 1 | 1 |
| E) comercially available chromium rinse sold under Trademark METASEAL E-1 by Stauffer Chemical Company | | 72.6g/8gal of water | 4.65 | 116°F. | 1 | 1 |

The results contained in Table II clearly demonstrate that the rare earth metal salt solutions of the present invention are comparable to chromium rinse solutions in corrosion and paint adherence.

EXAMPLE 2

Composite steel/galvanized steel panels are processed in the same manner as the panels of Example 1 except that the panels are warm air dried instead of oven dried. The panels are painted with a 0.5–0.6 mil coating of Forbes ED1124A electrodeposition primer, baked for 15 minutes at 350°F, painted with 0.3 mil coating of Forbes 80-606 electrodeposition paint and baked for 40 minutes at 350°F. The panels are subsequently painted with a 1.7–1.8 mil coat of Dupont 926-99642 acrylic lacquer and baked for 30 minutes at 310°F. The panels are then tested in the same manner as Example 1 for 168 hours. The composite joint rating is based on a visual rating from 0 to 5, with 0 being a perfect rating. The results are given in Table III.

TABLE III

| Rinse Concentrate | Rinse Solution | pH | Temperature | Scribe Creep at 168 hrs. (32nds of inch) Steel | Galvanized Steel | Composite Joint |
|---|---|---|---|---|---|---|
| Concentrate C | 32ml of Concentrate C/8gal of water | 4.55 | 113°F. | 2.1–2.8 | < 1.0 | 1 |
| Commercially available chromium rinse sold under the | 72.6g of Metaseal E/8gal of water | 4.60 | 117°F. | 2.2–2.6 | < 1 | 1 |

TABLE III-continued

| Rinse Concentrate | Rinse Solution | pH | Temperature | Scribe Creep at 168 hrs. (32nds of inch) Steel | Galvanized Steel | Composite Joint |
|---|---|---|---|---|---|---|
| Trademark Metaseal E-1 by Stauffer Chemical Company | | | | | | |

An analysis of the data of Table III shows that the rare earth metal rinses of the present invention are comparable to commercially available chromium rinses.

EXAMPLE 3

Flat polished, cold rolled steel panels are processed in a manner similar to that employed in Example 1 with the exception that the panels are warm air dried after the deionized water rinse instead of oven dried. The panels are painted with Forbes ED1124A electrodeposition primer at 400 volts for 135 seconds at a paint bath temperature of 67°–68°F. The panels are aged for 72 hours, scribed and tested according to the procedure described in Example 1. The results are contained in Table IV.

TABLE IV

| Rinse Concentrate | | Rinse Solution | pH | Temperature | Scribe Creep 32nds of Inch 168 hrs. | 336 hrs. |
|---|---|---|---|---|---|---|
| Concentrate B | | 57ml. of concentrate B/8gal of water | 4.35 | 116°F. | < 1 | < 1 |
| F) cerous nitrate hexahydrate | 30% | 23.5ml. of concentrate E/8gal of water | 4.30 | 90°F. | < 1 | < 1 |
| Phytic Acid (70%) | 10% | | | | | |
| Water | 60% | | | | | |
| Commercial chrome rinse Metaseal E-1 | | 72.6g of Metaseal E⅛gal of water | 4.70 | 107°F. | < 1 | < 1 |

EXAMPLE 4

Flat polished, cold rolled steel panels are processed according to the procedure of Example 1. Subsequent to this treatment, the panels are painted with Forbes ED 1124A electrodeposition primer at 350 volts for 135 seconds in a bath at 67°–70°F. and baked for 45 minutes at 350°F. The results of these tests are contained in Table V.

TABLE V

| Rinse Concentrate | | Rinse Solution | pH | Temperature | Scribe Creep Back 168 hrs. | 336 hrs. |
|---|---|---|---|---|---|---|
| G) cerous acetate | 5.0% | 60ml of concentrate F/8 gal of water | 4.50 | 100°F. | < 1 | 1.8 |
| glacial acetic acid | 20.0% | | | | | |
| water | 75.0% | | | | | |
| H) cerium acetyl acetonate | 5.0% | 60ml of concentrate G/8 gal of water | 4.40 | 94°F. | < 1 | 1.7 |
| glacial acetic acid | 20.0% | | | | | |
| water | 75.0% | | | | | |

EXAMPLE 5

Flat polished steel panels are processed in the following manner:

1. Sprayed for 90 seconds at 155°F. with a commercially available iron phosphate conversion coating sold under the Trademark Metacote by Stauffer Chemical Company.

2. Spray water rinse for 60 seconds at ambient temperature.

3. Dip rinsed for 30 seconds at 93°F. in a final rinse formulated by adding 45 ml. of Concentrate C per 8 gallons of water (pH - 3.2).

The panels are then painted with Dupont Flocoat 63-1948 and a topcoat of Inmont R-ML67-HD006. The resultant panels showed excellent corrosion and paint adhesion characteristics.

What is claimed is:

1. A process for increasing the corrosion resistance of conversion coated metal surfaces which comprises rinsing said conversion coated surface with an aqueous acidic solution consisting essentially of a rare earth metal salt, said solution having a molarity of at least 0.000001M and a pH adjusted to a value in the range from about 2.0 to about 6.5

2. The process of claim 1, wherein said rare earth metal salt is a cerous salt.

3. The process of claim 1, wherein said aqueous solution has a molarity of at least 0.0001M and pH in the range from about 2.5 to about 6.0.

4. The process of claim 1, wherein the pH is adjusted with an acid selected from the group consisting of nitric, phytic, and gluconic acid.

5. The process of claim 4, wherein said acid is nitric acid.

6. A process for treating metal surfaces to render them corrosion resistant which comprises:

a. cleaning said metal surface;

b. forming a conversion coating on said cleaned metal surface, said coating being selected from the group consisting of phosphates, mixed phosphate oxides, oxalate, arsenate, and chromate; and c. rinsing said conversion coated metal surface with an aqueous acidic solution of the salt of a rare earth metal having a molarity of at least about 0.000001M and a pH from about 2.0 to about 6.5.

7. The process of claim 6, wherein said rare earth metal salt is a cerous salt.

8. The process of claim 7, wherein said conversion coating formed on the metal surface is a phosphate coating selected from the group consisting of zinc phosphate, calcium-zinc phosphate, iron phosphate and manganese phosphate.

9. The process of claim 7, wherein said conversion coating formed on the metal surface is a zinc phosphate coating.

10. The process of claim 7 containing the additional step of water rinsing said conversion coated metal surface prior to rinsing said surface with said rare earth metal salt solution.

11. The process of claim 7 additionally containing the step of water rinsing said conversion coated metal surface with deionized water after said surface has been rinsed with said rare earth metal solution.

12. The process of claim 7 wherein said cerous salt is cerous nitrate.

13. The process of claim 11, wherein said cerous salt solution is adjusted to a pH in the range from about 2.5 to about 6.0 by the addition of an effective amount of nitric acid.

* * * * *